United States Patent [19]

Dorn et al.

[11] 4,159,936

[45] Jul. 3, 1979

[54] PROCESS FOR HYDROGENIZED RECONDITIONING OF CRUDE OIL OR RESIDUES DERIVED THEREFROM INTO SATURATED LIGHT HYDROCARBONS

[75] Inventors: Rainer Dorn, Bräuningshof; Christian Koch; Kurt Reiter, both of Erlangen; Konrad Künstle, Röttenbach, all of Fed. Rep. of Germany

[73] Assignee: Kraftwerk Union Aktiengesellschaft, Mülheim, Fed. Rep. of Germany

[21] Appl. No.: 837,110

[22] Filed: Sep. 28, 1977

[30] Foreign Application Priority Data

Oct. 6, 1976 [DE] Fed. Rep. of Germany ..... 2645132

[51] Int. Cl.$^2$ ..... C10G 13/00; C10G 37/00

[52] U.S. Cl. ..... 208/93; 208/95; 208/107

[58] Field of Search ..... 208/92, 93, 95, 142, 208/143, 107

[56] References Cited

U.S. PATENT DOCUMENTS

| | | | |
|---|---|---|---|
| 3,044,951 | 7/1962 | Schlinger et al. | 208/95 |
| 3,380,910 | 4/1968 | Griffiths | 208/95 |
| 3,755,137 | 8/1973 | Schuman | 208/143 |
| 3,905,892 | 9/1975 | Gregoli et al. | 208/95 |

*Primary Examiner*—Herbert Levine
*Attorney, Agent, or Firm*—Herbert L. Lerner

[57] ABSTRACT

Refining of crude petroleum by fractionally distilling the crude into lighter cuts and distillate bottoms constituting more than 50% of the crude. Hydrogenating the distillate bottoms at a temperature above 700° C. in a tubular reactor to produce saturated hydrocarbons, some gas and a solid carbonaceous material. Separating the solid material in a cyclone and returning the hydrogenated oil to the fractionating column. Passing the solid carbonaceous material by an extruder to a second tubular reactor in contact with a mixture at a temperature above 750° C. of steam, 1 and 2 carbon atom gases, and combustion products containing $O_2$ from a third cyclone. Discharging the reaction products containing unreacted carbonaceous material together with substantially no $O_2$, production of $H_2$ and increased amounts of CO and $CO_2$ into a second cyclone. Separating the gaseous products from the solid, recovering $H_2$ and passing it to the first reactor tube. Extracting heat from the gaseous reaction products to superheat the steam entering the second tubular reactor and to preheat the distillate bottoms prior to entrance in the first tubular reactor. Passing the remaining solid carbonaceous material by an extruder together with excess $O_2$ into a third tubular reactor to effect substantially complete combustion. Discharging the unburned solid residue and combustion gases into a third cyclone from which the combustion gases are sent to the second tubular reactor and the residue containing ash is discharged from the system.

4 Claims, 1 Drawing Figure

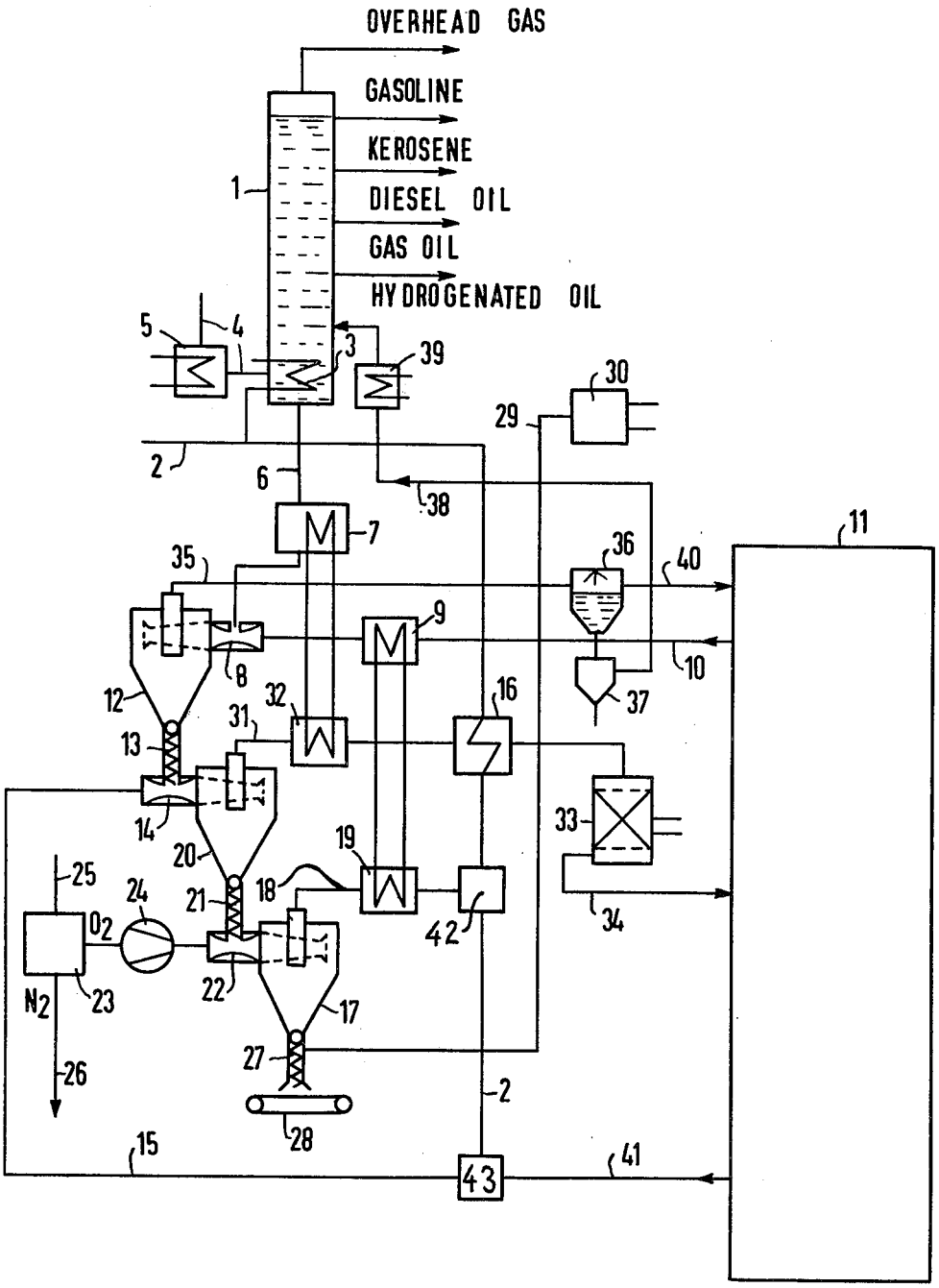
OVERHEAD GAS
GASOLINE
KEROSENE
DIESEL OIL
GAS OIL
HYDROGENATED OIL
1
2
3
4
5
6
7
8
9
10
11
12
13
14
15
16
17
18
19
20
21
22
23
24
25
26
27
28
29
30
31
32
33
34
35
36
37
38
39
40
41
42
43
O2
N2

PROCESS FOR HYDROGENIZED RECONDITIONING OF CRUDE OIL OR RESIDUES DERIVED THEREFROM INTO SATURATED LIGHT HYDROCARBONS

BACKGROUND OF THE INVENTION

1. Field of the Invention

This invention relates to refining of petroleum and more particularly refers to a new and improved method and apparatus for treating crude oil to convert it almost entirely into liquid and gaseous hydrocarbons.

2. Description of the Prior Art

In the processing of crude oil in a petroleum refinery, the crude oil is first fed to an installation for atmospheric distillation. As described, for instance, in the book "Die Verarbeitung des Erdoels" — Petroleum Processing — by Riediger, Springer-Verlag 1971, and shown on page 953 in FIG. N/6, the installation for atmospheric distillation is followed by a further installation for vacuum distillation as well as individual facilities for the cracking of carbon compounds. Even so one obtains 20%, based on the weight of the crude oil used, of low-quality and hard to process residues. These residues are hard to use particularly for the reason that their sulfur content is high. To also desulfurize these residues and to process them into light hydrocarbons, hydrogenation processes must be employed which are expensive because of their large hydrogen requirements, and are therefore uneconomical. For this reason, in the operation, conditions for the atmospheric distillation and particularly its sump temperature are chosen so high that as little residue as possible is required to be drained from the bottom of the distillation tank.

SUMMARY OF THE INVENTION

It is an object of the present invention to provide a system, using an installation for atmospheric distillation, which, first, permits the almost complete processing of the crude oil employed into light hydrocarbons and which, secondly, results in substantially decreased pollution of the environment due to a reduction of combustion processes in the facility, without losses of the efficiency of the overall installation.

With the foregoing and other objects in view, there is provided in accordance with the invention a process for the refining of petroleum which includes subjecting crude petroleum to fractional distillation in a distillation zone under substantially atmospheric pressure to separate the crude oil into more volatile fractions and less volatile distillate bottoms, maintaining a sufficiently low temperature in the distillation zone to cause the distillate bottoms to separate in a fraction of at least 50% of the crude oil, passing the distillate bottoms into a first reaction zone into which is also introduced hydrogen at a temperature above 700° C. in intimate contact with the distillate bottoms to hydrogenate the distillate bottoms to a major amount of substantially saturated normally liquid hydrocarbons with the concomitant production of a lesser amount of solid carbonaceous material, and minor amounts of noncondensable components including normally gaseous hydrocarbons and unreacted hydrogen, separating the solid carbonaceous material from the remaining reaction products of hydrogenated oil and noncondensable components, passing the separated solid carbonaceous material into a second reaction zone in intimate contact with a mixture, at a temperature in excess of 750° C., of steam, gaseous hydrocarbons having less than 3 carbon atoms, and the gaseous combustion products of a third separator containing $CO_2$, $O_2$ and CO, to produce as reaction products a reduced amount of solid carbonaceous material, consumption of the $O_2$, reduction in $H_2O$ content, with production of $H_2$ and increased amounts of CO and $CO_2$, separating the remaining solid carbonaceous material from the reaction products of the second reaction zone, passing said remaining carbonaceous material into a third reaction zone into which is introduced excess oxygen to effect substantially complete combustion of the carbonaceous material to produce gaseous combustion products containing $CO_2$, $O_2$ and CO and a solid residue containing unburned material and ash, separating the gaseous combustion products from the solid residue containing unburned material and ash, passing the separated gaseous combustion products into said second reaction zone, extracting heat from the reaction products of the second reaction zone separated from the carbonaceous material to superheat the steam entering the second reaction zone and to preheat the distillate bottoms prior to entrance into the first reaction zone, cooling the separated reaction products of hydrogenated oil and noncondensable components to condense the hydrogenated oil, separating hydrogenated oil condensate from the noncondensable components, and returning the hydrogenated oil condensate to the distillation zone for fractional distillation into fractions of different volatility.

There is provided in accordance with the invention an apparatus for the refining of crude petroleum including a fractionating column, a crude oil inlet in the fractionating column for the introduction of crude petroleum, a plurality of product outlets in the fractionating column at the top and side for the withdrawal of fractions of the more volatile hydrocarbons, a distillate bottoms outlet in the bottom of the column for the discharge of the less volatile distillate, means for controlling the temperature in the bottom of the column for the distillate bottoms to separate into a fraction of at least 50% of the crude oil, a first tubular reactor into which the distillate bottoms are sprayed, a hydrogen inlet to the first reactor into which hydrogen at a temperature above 700° C. enters in contact with the distillate bottoms producing condensable saturated hydrocarbons, normally gaseous hydrocarbons, and solid carbonaceous material, a first cyclone into which the discharge end of the first reactor tube extends, an outlet from the first cyclone for the release of vaporous and gaseous reaction products separated in the first cyclone, cooling means for cooling the vaporous and gaseous reaction products separated in the first cyclone and condensing the vapors to hydrogenated oil condensate, a vessel for collecting and separating the hydrogenated oil condensate from the gaseous reaction products, and a conduit for conducting the hydrogenated oil condensate into the fractionating column, a first extruder connected to the bottom of the first cyclone for the discharge of solid carbonaceous material, a second tubular reactor with an opening connected to the outlet of the first extruder for the discharge of solid carbonaceous material into the second reactor tube, an inlet into the second reactor tube for the introduction of a mixture at a temperature in excess of 750° C. of steam, gaseous hydrocarbons having less than 3 carbon atoms and gaseous combustion products from a third cyclone, a second cyclone into which the discharge end of the second reactor tube extends, an outlet from the second cyclone for the release of gaseous reaction products, a heat exchanger for transferring heat from the gaseous reaction products to superheat steam entering the second reactor tube, heat transfer means for transferring heat from the gaseous reaction products to preheat distillate bottoms before entering the first reactor tube, a second extruder connected to the bottom of the second cyclone for the discharge of solid carbonaceous material, a third tubular reactor with an opening connected to the outlet of the second extruder for the discharge of solid carbonaceous material into the third reactor tube, an inlet into the third reactor tube for the introduction of excess oxygen to effect substantially complete combustion of the carbonaceous material into gaseous combustion products and solid residue, a third cyclone into which the discharge end of the third reactor tube extends, an outlet from the third cyclone and connecting conduit for passing the gaseous combustion products to the second tubular reactor, and a third extruder connected to the bottom of the third cyclone for the discharge of solid residue.

Other features which are considered as characteristic for the invention are set forth in the appended claims.

Although the invention is illustrated and described herein as embodied in a process for hydrogenized reconditioning of crude oil or residues derived therefrom into saturated light hydrocarbons, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing in which is diagrammatically illustrated a system for refining crude into distillate oils without by-product production of heavy non-volatile residuum and solid carbonaceous material.

DETAILED DESCRIPTION OF THE INVENTION

Petroleum is a complex mixture of hydrocarbons of widely different boiling point. These hydrocarbons are accompanied by organic compounds of sulfur, nitrogen, or oxygen, present in from negligible amounts to a number of percent. The oils from different fields vary in physical properties and chemical composition. Hydrocarbons of paraffin, unsaturated, naphthene, and aromatic series occur in varying proportions. Generally the first step in petroleum refining is the separation of crude oil into its various products by fractional distillation. Oil may be heated to almost 800° F. (426° C. ) and introduced into the lower portion of a fractionating tower wherein the larger part is vaporized, separated into a succession of fractions with gas or sometimes gas and gasoline vapors taken off the top of the tower and a series of heavier oils taken off as liquids at various lower levels, which may be, in order of decreasing volatility, naphtha, kerosene, diesel oil, and gas oil. The temperature of the oil in the lower part of the tower is high to vaporize most of the crude oil leaving generally less 20% by weight of heavy bottoms which are drawn off at the bottom of the tower.

Contrary to the known procedure of refining as described, the sump temperature i.e. the temperature of the oil in the bottom of the tower subjected to atmospheric distillation is limited to about 525° F. (275° C.) and thereby, an increase of the quantity of residue or distillate bottoms from the atmospheric distillation installation to over 50% of the crude oil charged is intentionally obtained. Steam from a light-water reactor with a pressure of about 60 bar may thereby be used for heating the installation for atmospheric distillation. Thus, the sump products or distillate bottoms contain a larger share of low-boiling components, which brings about an easier distribution of the oil in the reactant hydrogen stream in the hydrogenation by thermal jet decomposition and assists in the hydrogenation through the formation of hydrogenated products. These products could also be produced by hydrogenating in the known installation. Steam from a nuclear reactor may also be used for processing the residues or still bottoms according to the invention. Thus, the process according to the invention processes the entire residue almost completely into saturated hydrocarbons. The saturated hydrocarbons or hydrogenated oil are then fed into the tower for the atmospheric distillation of the crude oil at a point above the inlet point for the crude oil. This makes a facility for vacuum distillation following the atmospheric distillation installation unnecessary and also reduces the facilities for cracking the oil.

In the atmospheric distillation of crude oil, the sump temperature of the oil undergoing atmospheric distillation in the tower is kept so low that more than 50% but preferably not more than 80% by weight of the crude oil accumulates as residue. An oil temperature below 275° C. to about 200° C., depending on the composition of the crude oil will generally be adequate to produce distillate bottoms constituting 50 to 80% of the crude oil. The temperature may be controlled by raising or lowering the temperature of the incoming crude oil. Alternatively, a cooled liquid product or unheated crude oil may be introduced into the tower to maintain the desired temperature. This residue is nozzle-sprayed in a first reaction tube with a stream of hydrogen at a temperature of above 700° C., preferably between 725° C. and 775° C. The reaction may be conducted under substantially atmospheric pressure and also under superatmospheric pressure. Spraying the distillate bottoms through a nozzle divides the liquid oil into droplets which due to the flow of hydrogen and the thermal effect of the high temperature hydrogen further atomizes the droplets into finer particles thereby providing more intimate contact with the hydrogen and promoting the reaction. Various and to some extent competing reactions take place. The primary reaction is hydrogenation of the unsaturated hydrocarbons to produce more saturated or substantially saturated hydrocarbons. A secondary concomitant reaction appears to be dehydrogenation and polymerization to produce a solid carbonaceous material in an amount of about 5 to 25% by weight of the bottoms, which approaches carbon, together with non-volatile matter such as mineral matter and ash. At the prevailing high temperature, a small amount of cracking occurs with the production of some normally gaseous hydrocarbons including gases containing 1 and 2 carbon atoms. Desulfurization also occurs, frequently with the production of $H_2S$ which is later removed.

The reaction mixture of condensable hydrogenated oil vapors, gases, and solid carbonaceous material are introduced into a first cyclone wherein the oil vapors and gases are separated from the solid carbonaceous material.

The solids from the first cyclone are introduced into a second reaction tube with a mixture, heated to over 750° C., preferably between 775° C. and 850° C., consisting of flowing steam, of excess, saturated hydrocarbons with one and two carbon atoms, and of the gaseous constituents of the third cyclone, containing elementary oxygen, carbon monoxide and carbon dioxide. The effect of this reaction is to reduce the amount of solid carbonaceous material to less than half, usually to about ½ to ⅓, and convert it by reaction with the steam and oxygen to hydrogen and additional carbon monoxide and carbon dioxide. The remaining solid carbonaceous material is separated from the gaseous reaction products in a second cyclone. The gaseous constituents leaving the second cyclone serve to superheat the steam introduced into the first reaction tube. The condensable components leaving the first cyclone are precipitated in a gas scrubbing and processing facility and are returned to the distillation tank for atmospheric distillation. The solid components leaving the second cyclone are introduced into a third reaction tube, which precedes the third cyclone, together with a stream of excess oxygen to effect substantially complete combustion of the carbonaceous solids and produce combustion gases containing free oxygen. The ash is discharged from the third cyclone.

Referring to the drawing, steam with a pressure of about 60 bar for heating the distillation tank 1 is fed to the heating coil 3 via a steam line 2. The heated crude oil is fed through line 4 into the lower part of the distillation tank 1, which may be any suitable fractionating tower, preferably of the bubble-cap type. A heat exchanger 5 inserted into the line 4 heats the crude oil to a temperature sufficient to vaporize less than 50% of the more volatile constituents. Due to the temperature of the heating coil 3, which is low relative to the known atmospheric distillation, less than one-half of the fed-in crude oil evaporates in the lower part of the distillation tank 1. The remainder or still bottoms flows by gravity through line 6, then through a heat exchanger 7 into a first reaction tube 8. Hydrogen is blown into this reaction tube 8. The hydrogen first heated in a heat exchanger 9, may come from an external source or is made available via a line 10 from a gas processing plant 11 which is a conventional plant for separating hydrogen from the mixture of gases produced in the process. In the first reaction tube 8, the sprayed-in oil reacts with the hydrogen which is at about 750° C. in accordance with the following equation:

$$120(C\,H_{1.6}) + 15.3\,H_2 \longrightarrow 106\,(C\,H_{2.1}) + 14\,C$$
(slightly exothermic)

The reaction tube 8 is gradually tapered to increase the velocity of the gas flowing therein and is expanded after a short cylindrical section just before it ends, in order to stabilize the flow. It opens into a first cyclone 12, in which gaseous components are separated from the solid parts of the mixture.

The solids are fed via an extruder 13 to a second reaction tube 14. The inlet end of the second reaction tube 14 is connected via a line 15 and a heat exchanger 16 for superheating the steam to the steam line 2. In addition, a gas line 18 coming from a third cyclone 17 leads via a cooler 19 into the line 15. A mixture of steam and the gases leaving the third cyclone is fed to the second reaction tube 14. Thus, the following reaction takes place in the second reaction tube 14:

$$14C + 15.3\,H_2O + 2.85\,O_2 + 3\,CO_2 + CO \longrightarrow$$
$$4\,C + 6\,CO + 8.8\,CO_2 + 6\,H_2O + 9.3\,H_2 - 0.79\ \text{kcal/}CH_{1.6}$$

The second reaction tube 14 has the same shape as the first reaction tube 8 and opens into a second cyclone 20. The solid particles collecting there move through an extruder 21 into a third reaction tube 22, which opens into the third cyclone 17. The inlet of the reaction tube 22 is connected to the outlet for oxygen of an air separation facility 23 of conventional design for the separation of oxygen from nitrogen. A compressor 24 provides a sufficiently high flow velocity of the oxygen into third reaction tube 22. The air separation facility is supplied with outside air via an intake line 25. The outlet line 26 serves for discharging the nitrogen produced. In the third reaction tube 22, the carbonaceous solids charged-in by the extruder 21 react with the oxygen from the air separation facility 23 according to the following formula:

$$C\,4 + 6.35\,O_2 \longrightarrow$$
$$CO + 3\,CO_2 + 2.85\,O_2 - 2.67\ \text{kcal/mol}\ (C\,H_{1.6})$$

In the third cyclone 17, the gaseous components leaving the third reaction tube 22 are separated from the remaining ash and the residue. The ash and the residue are removed by an extruder 27 from the third cyclone 17 and discharge onto a conveyer belt 28 for removal. A blowdown line 29 leads into the lower part of the third cyclone 17 and feeds the sludge accumulated in a water purification plant 30 of the refinery to mix with the hot ash of the third cyclone 17.

The gases leaving the second cyclone 20 flow through a gas line 31 and first, into the heat exchanger 16 to superheat the steam in the steam line 2. The gases also pass through heat exchanger 32 wherein they are cooled and transfer heat to preheat distillate bottoms via heat exchanger 7. From there the gases flow into a known conversion facility 33, in which the steam is reacted in accordance with the following equation:

$$6\,CO + 8\,CO_2 + 6\,H_2O + 9.3\,H_2 \longrightarrow$$
$$14\,CO_2 + 15.3\,H_2 - 0.49\ \text{kcal/mol}\ (C\,H_{1.6})$$

The gas mixture leaving the conversion facility 33 flows through line 34 to the gas processing installation 11 which may be any suitable facility for the separation of gases. Here, the hydrogen contained in this mixture is separated from the other gases, particularly the acidic gases, namely $CO_2$ and $H_2S$. The separated hydrogen is returned to the reaction tube 8 via the line 10. The heat exchanger 9 inserted into the line 10 is connected with its coil to the coil of the cooler 19. Thereby, the waste heat of the gas leaving the third cyclone 17 is used for heating the hydrogen. In a similar manner, the coil of the heat exchanger 32 is connected to the coil of the heat exchanger 7, so that the gases leaving the second cyclone 20 serve for preheating the oil mixture which is drained from the distillation tank 1.

The gaseous products which leave the second cyclone 20 and the third cyclone 17 thus serve to provide the necessary heat for heating the hydrogen and the steam of the first and second reaction tubes and also to generate the hydrogen required for the first reaction tube 8. In order to prevent the temperature from rising continuously during the operation of the installation, part of the gases leaving the second and third cyclone are led past the coolers or heat exchangers. This by-pass connection for controlling the temperature level, however, is not incorporated into the drawing. The saturated hydrocarbons, which represent the major useful product from the reactions in the first, second and third reaction tubes, are released from the first cyclone 12 and flow through a gas line 35 to a conventional gas scrubbing and processing facility 36, 37. Here, the condensible light hydrocarbons contained in the gas are condensed and are directed via an oil line 38 into the distillation tank 1 above the crude oil inlet. A steam-heated heat exchanger 39 is inserted into the oil line 38 to heat the oil to the desired temperature. The non-condensable components leave the gas scrubbing and processing facility 36, 37 and flow through line 40 into the gas processing plant 11. Here, the gaseous components contained therein are separated and directed to the respective reaction tubes, i.e. the separated hydrogen flows into the first reaction tube 8, and the separated hydrocarbon components into the second reaction tube 14. For this purpose, the gas processing plant 11 is connected to the line 15 via a line 41.

If a light-water reactor is used for generating the heating steam and the reaction steam, the process according to the invention makes possible an almost 100% processing of the crude oil components used into light hydrocarbons with simultaneously substantially reduced environment pollution by excluding combustion processes in the refinery.

The following example illustrates the present invention:

A Wyoming crude oil, with a specific gravity of 0.815 (42.1° API), a pour point of 60° F. and a Viscosity, Saybolt Universal of 42 sec at 77° F. and 36 sec at 100° F. is submitted to an atmospherical distillation at a rate of 397 kg/sec, at 250° C. in the distillation tank 1, using 413 kg/sec of saturated steam of about 280° C. coming from a nuclear steam supply system and passing through pipe 2 into the heating coil 3.

In the distillation tank 1, 47% of the crude is evaporated. The crude is preheated in the preheater 5 by a steam flow of about 27 kg/sec.

A residue flow of about 210 kg/sec is extracted through pipe 6, passing heat-exchanger 7 and is fed through the first reaction tube 8 into the cyclone 12.

Hydrogenated oil coming from separator 37 at a flow of 182 kg/sec is recycled into the distillation tank 1 through oil line 38 and the steam heated heat-exchanger 39.

Hydrogen at a temperature of 800° C. at a pressure of about 50 bar and at a rate of 44 $m^3_n$/sec is injected into the same reaction-tube 8, through line 10 and heat-exchanger 9. Under these conditions the hydrogen reacts with the residue producing light components. In cyclone 12 the remaining heavy components are separated from the vapours.

The temperature in this cyclone is at about 400° to 600° C.

The vapours at a flow of about 182 kg/sec. are fed through gas line 35 into the gas scrubbing and processing facility 36.

The condensable components are separated in the gas scrubbing and processing facility 37, the gases continue through line 40 to the gas processing plant 11.

The remaining heavy components are fed via the extruder 13 to a second reaction tube 14 at a temperature of about 400°–600° C. and a rate of 42 kg/sec. Into the same reaction tube 14 a mixture of 290 kg/sec of steam, 26 kg/s of CO and $CO_2$, and 20 kg/sec of burnable gases is injected at a temperature of about 800° C. The steam coming from the nuclear steam generator through steam line 2 is superheated in heat-exchanger 16 using the gases leaving the second cyclone 20 through gas lines 31 as the heating-agent. Hot gases leaving the third cyclone 17 at a temperature of about 1000° C. through gas line 18 passing then through cooler 19 are mixed with the superheated steam in mixer 42. This gas mixture continues through steam line 2 to the mixer 43 where the burnable gases coming from the gas processing plant 11 through line 41 are added. The product gas separated in the second cyclone 20 is a mixture of $H_2$, CO, $CO_2$ and $H_2O$. It is cooled down in the heat exchangers 32 and 16 and then taken to the conversion facility 33 and from there into the gas processing plant 11. The flow is rated in order to provide the hydrogen input of 44 $m^3_N$/sec fed through line 10 and heat-exchanger 9 into the reaction tube 8.

The coke remaining in second cyclone 20 is fed into the third reaction tube 22 by means of the extruder 21 at a rate of 26 kg/sec. Oxygen produced in the air separation facility 23 is compressed by compressor 24 and fed into the reaction tube 22 at a rate of 18 $m^3_N$/sec. In third cyclone 17 ash and an organic residue is separated from the gases and removed by the extruder 27 at a rate of 20 kg/sec. Sludge from the water purification plant 30 is fed via blowdown line 29 into this extruder to be burnt and the ash removed. The pressure in all reaction tubes is at about 50 bar.

The products of this plant are:

27 kg/sec of overhead gas,
132 kg/sec of gasoline
59 kg/sec of kerosene
99 kg/sec of diesel oil and
59 kg/sec of gas oil Assuming a load factor of 80%, 10 million tons of crude per year could be processed with this plant.

Process steam and electrical power would be provided by a nuclear power station of 3765 MW thermal output.

There are claimed:

1. A process for the refining of petroleum which comprises subjecting crude petroleum to fractional distillation in a distillation zone under substantially atmospheric pressure to separate the crude oil into more volatile fractions and less volatile distillate bottoms, maintaining a sufficiently low temperature in the distillation zone to cause the distillate bottoms to separate in a fraction of at least 50% of the crude oil, passing the distillate bottoms into a first reaction zone into which is also introduced hydrogen at a temperature above 700° C. in intimate contact with the distillate bottoms to hydrogenate the distillate bottoms to a major amount of substantially saturated normally liquid hydrocarbons with the concomitant production of a lesser amount of solid carbonaceous material, and minor amounts of noncondensable components including normally gaseous hydrocarbons and unreacted hydrogen, separating the solid carbonaceous material from the remaining reaction products of hydrogenated oil and noncondensable components, passing the separated solid carbonaceous material into a second reaction zone in intimate contact with a mixture, at a temperature in excess of 750° C., of steam, gaseous hydrocarbons having less than 3 carbon atoms, and the gaseous combustion products of a third separator containing $CO_2$, $O_2$ and CO, to produce as reaction products a reduced amount of solid carbonaceous material, consumption of the $O_2$, reduction in $H_2O$ content, with production of $H_2$ and increased amounts of CO and $CO_2$, separating the remaining solid carbonaceous material from the reaction products of the second reaction zone, passing said remaining carbonaceous material into a third reaction zone into which is introduced excess oxygen to effect substantially complete combustion of the carbonaceous material to produce gaseous combustion products containing $CO_2$, $O_2$ and CO and a solid residue containing unburned material and ash, separating in said third separator the gaseous combustion products from the solid residue containing unburned material and ash, passing the separated gaseous combustion products into said second reaction zone, extracting heat from the reaction products of the second reaction zone separated from the carbonaceous material to superheat said steam entering the second reaction zone and to preheat the distillate bottoms prior to entrance into the first reaction zone, cooling the separated reaction products of hydrogenated oil and noncondensable components to condense the hydrogenated oil, separating the hydrogenated oil condensate from the noncondensable components, and returning the hydrogenated oil condensate to the distillation zone for fractional distillation into fractions of different volatility.

2. Process according to claim 1, wherein said gaseous combustion products containing $CO_2$, $O_2$ and CO after separation from solid residue effects the final heating of the hydrogen fed to the first reaction zone and are subsequently added to the gases entering the second reaction zone.

3. Process according to claim 1, wherein the steam for the second reaction zone is generated in a nuclear reactor installation.

4. Process according to claim 1, wherein hydrogen is obtained from the reaction products of the second reaction zone after separation of the solid carbonaceous material and wherein at least part of this hydrogen is conducted to the first reaction zone.

* * * * *